United States Patent [19]

Marcusen

[11] Patent Number: 5,071,030

[45] Date of Patent: Dec. 10, 1991

[54] ADHESIVE LABEL SEPARATOR

[76] Inventor: Carroll L. Marcusen, 711 East Gorham St., Madison, Wis. 53702-1521

[21] Appl. No.: 558,953

[22] Filed: Jul. 26, 1990

[51] Int. Cl.[5] ..... B65H 5/28

[52] U.S. Cl. ..... 221/2; 221/3; 221/73

[58] Field of Search ..... 221/2-3, 221/25, 70-73, 311; 156/DIG. 28, 30, 33; 101/288; 74/89.14

[56] References Cited

U.S. PATENT DOCUMENTS

| | | | |
|---|---|---|---|
| 3,923,199 | 12/1975 | Real | 221/73 |
| 4,094,438 | 6/1978 | Neubauer | 221/71 |
| 4,402,424 | 9/1983 | Mattix | 221/73 |
| 4,432,830 | 2/1984 | Jue | 101/288 |
| 4,434,911 | 3/1984 | Sakura | 221/73 |
| 4,450,035 | 5/1984 | Hamisch, Jr. et al. . | |
| 4,497,420 | 2/1985 | Stelcher et al. | 221/73 |
| 4,619,151 | 10/1986 | Trachman et al. | 74/89.14 |
| 4,639,287 | 1/1987 | Sakura | 221/73 |
| 4,650,056 | 3/1987 | Sevennec et al. | 74/89.14 |
| 4,676,859 | 6/1987 | Cleary, Jr. et al. . | |
| 4,679,103 | 9/1988 | Koike et al. . | |
| 4,769,110 | 9/1988 | Ohno et al. . | |
| 4,813,571 | 3/1989 | Slagter . | |
| 4,826,558 | 5/1989 | Wada et al. . | |
| 4,840,694 | 6/1989 | Brookman et al. . | |
| 4,947,747 | 8/1990 | Hermann | 101/288 |

*Primary Examiner*—David H. Bollinger

*Attorney, Agent, or Firm*—Andrus, Sceales, Starke and Sawall

[57] ABSTRACT

An adhesive label separator has an edge for abruptly changing the path of the backing paper to achieve separation of the label from its backing paper. A mechanism is provided for adjusting the height of the edge to accommodate different sizes of labels, and also to deactivate the separator. The height adjustment mechanism may be a pin and slot assembly, or it may be motor-driven. A sensor mechanism is provided for sensing whether the label has been removed from the paper. The label separator is suitable for use with typewriters and computer printing devices.

8 Claims, 2 Drawing Sheets

FIG. 1
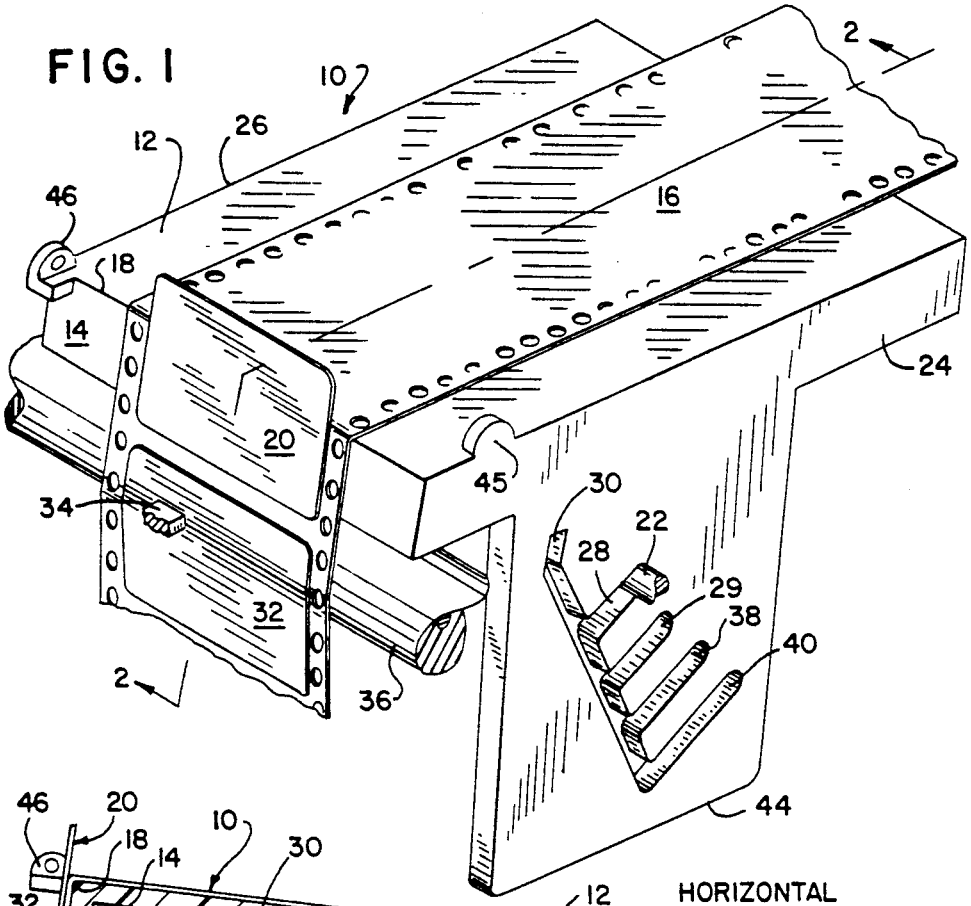
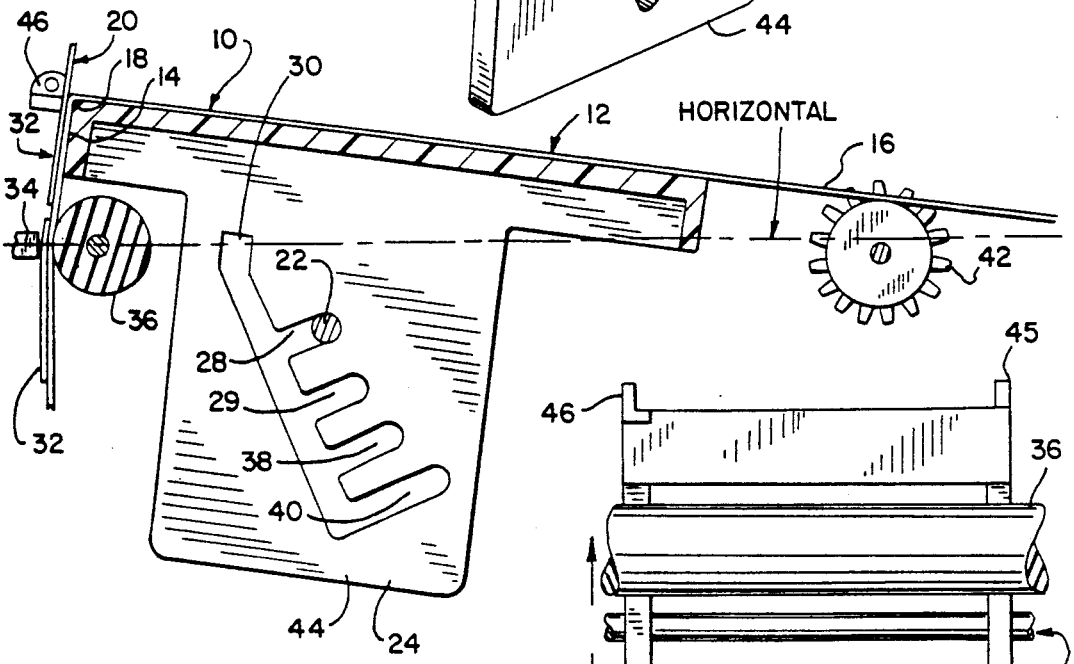
FIG. 2
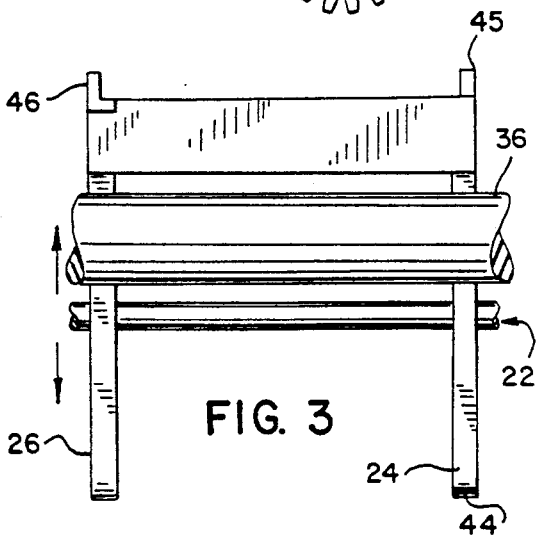
FIG. 3

ADHESIVE LABEL SEPARATOR

BACKGROUND OF THE INVENTION

This invention relates to devices for separating adhesive labels from their backing paper, and more particularly to such devices used with computer printers, typewriters or other printing apparatus.

Many businesses, organizations and individuals use labels on which information such as a mailing address is printed on one side, with the opposite side having an adhesive. The labels are made in sheets or rolls and have a backing paper which contacts the adhesive side. The backing paper is typically removed after the information is printed on the label so the adhesive side of the label may be placed on an envelope or another item by applying pressure to the label.

A major problem with using pressure-sensitive adhesive labels is finding a quick and easy manner to separate the label from the backing paper after the information has been printed on the label. For low volume applications, the label is typically manually separated from the backing paper by the operator using a fingernail. This manual process is very slow and tedious, may result in breakage of the fingernail, or cause damage to the label from bending the corners when removing the labels. Each new labelling operation often results in wasted labels, causing additional expense.

Label dispensing devices are known for the high-speed separation of labels from their backing paper. However, such high speed devices are typically complex and expensive, and are not suitable for low volume users. Moreover, these high speed devices are generally suitable for only a particular size of label; if nonstandard size labels are used, the separator may not be able to separate the labels from the backing paper.

Other label separators are known for placing information on one side of the label and for removing the backing material from the other side. Such label separators are typically hand-held and are not suitable for use with a printing device such as a typewriter, computer printer or the like.

SUMMARY OF THE INVENTION

Apparatus is disclosed for separating at least a portion of an adhesive label from its backing paper. The separator is designed for use with a printing device such as a typewriter, or with a computer printer including dot matrix, laser, thermal, daisy wheel, ink jet, or with other types of printers. The separator is particularly suitable for low-volume applications.

In its broadest form, the invention is a separator that separates at least a portion of the adhesive label from its backing paper when the paper moves along a path in a printing device. The separator comprises a support means for supporting the backing paper while the paper moves along the path in the printer, an edge means interconnected with the support means for abruptly changing the path of the moving backing paper, and an adjustment means for adjusting the relative position of the edge means with respect to the position of the printing device. The position of the adjustment means determines whether a portion of the adhesive label will be separated from the backing paper, or whether the separator will be deactivated to prevent the label from being separated from the backing paper.

In a preferred embodiment, the sensor means is provided for detecting whether a label has been removed from the paper after printing. The sensor means preferably includes a sensor beam. If the beam is unbroken and a label is queued and waiting to be printed or is then being printed, the printing device will continue to print the label. When the beam is broken, the printing of the label then being printed will be completed. Further printing of queued labels will cease until the sensor beam is again unbroken, indicating that the printed label has been removed.

The support means of the preferred embodiment includes a first surface that supports the backing paper after the backing paper has passed over the edge means. The first surface is interconnected with and is located on a first side of the edge means. The support means also preferably includes a second surface located on a second side of the edge means. The second surface supports the label and backing paper before the label reaches the edge means.

In one embodiment, the adjustment means includes a rod member interconnected with the printing device, and first and second attachment members interconnected with the edge means. The first attachment member has a first plurality of slots that are adapted to receive a first end of the rod member; the second attachment means has a second plurality of slots that are adapted to receive the second end of the rod member. Positioning the rod member ends in the slots allows the position of the separator and that of the edge means to be adjusted relative to the printing device.

In an alternate embodiment, the adjustment means may include a worm gear interconnected with the edge means and a motor having a rotatable shaft that engages the worm gear, so that rotation of the motor shaft rotates the gear to adjust the relative position of the edge means with respect to the position of the printing device.

It is a feature and advantage of the present invention to provide an adhesive label separator for use with typewriters and computer printers.

It is another feature and advantage of the present invention to provide an adhesive label separator that is inexpensive and suitable for low-volume users.

It is another feature and advantage of the present invention to minimize the number of wasted labels since labels are separated without bending their corners.

These and other features and advantages of the present invention will be apparent to those skilled in the art from the following detailed description of preferred embodiments and the attached drawings, in which:

BRIEF DESCRIPTION OF THE DRAWINGS

FIG. 1 is a perspective view of the separator and label assembly when the separator is in an up position.

FIG. 2 is a cross-sectional view of the separator depicted in FIG. 1 taken along line 2—2.

FIG. 3 is a front view of the separator according to the present invention.

DETAILED DESCRIPTION OF THE PREFERRED EMBODIMENTS

Figure 4A:
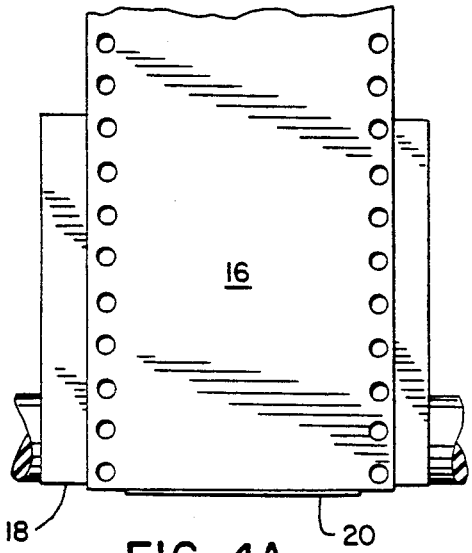
FIG. 4A is a top view of the separator and label assembly when the separator is in an up position.

FIG. 1 depicts the adhesive label separator according to the present invention in one of its up positions, as well as the backing paper and a partially separated label thereon. In FIG. 1, separator 10 includes a support means consisting of a first substantially planar surface 12 and a second substantially planar surface 14. First surface 12 is used to support that portion of backing paper 16 that has passed over edge means 18. Second surface 14 provides a firm, flat surface for the label and the backing paper before they reach edge means 18. Second surface 14 also provides strength to the support means. Surface 12 is interconnected with and lies on one side of edge 18, whereas surface 14 is interconnected with and lies on another side of edge 18.

Edge 18 is designed to provide an abrupt change in direction for backing paper 16, causing label 20 to become at least partially separated from backing paper 16 when separator 10 is in an up position, as depicted in FIG. 1. Edge 18 preferably creates about a 90° angle between surfaces 12 and 14, although other angles could be used.

The label separator also includes an adjustment means for adjusting the position of edge 18 with respect to the position of the printing device (FIG. 5) to accommodate different sizes of adhesive labels. The adjustment means determines which of several up positions is selected for the edge means depending upon the size of the adhesive labels being used. The edge means may also be positioned in a down position by the adjustment means to prevent labels from being separated from the backing paper, or to allow normal operation of the printing device without removing separator 10 from the printing device.

In FIG. 1, the adjustment means includes a rod member 22 whose first and second ends are interconnected with the printing device. The adjustment means also includes a first attachment member 24 and a second attachment member 26 which are interconnected with both the rod member and with edge 18 to enable the height of edge 18 to be adjusted by positioning rod member 22 in slot 28, slot 30, or another of the first plurality of slots in first attachment member 24. Similarly, the other end of rod member 22 is at the same time positioned in a corresponding slot (not shown) of second attachment member 26.

In FIGS. 1 and 2, the separator is in one of the up positions to permit edge 18 to separate at least a portion of label 20 from backing paper 16. After a portion of label 20 has been separated, the operator may manually separate or remove the remainder of label 20 from backing paper 16 and apply the label to an item such as an envelope.

Separator 10 as depicted in FIG. 1 is used with a dot matrix printer (FIG. 5) that accepts a continuous roll of tractor feed paper. Information is printed on one side of label 32 using an impact printing element 34 of a standard dot matrix printer. Platen 36 provides a firm surface opposite printing element 34 to oppose the impacting pins (not shown) in dot matrix printing element 34. Although the separator is shown as being used with an impact dot matrix printer, it is apparent that the separator may be used with many other types of printing devices, including typewriters, laser, thermal, daisy wheel, ink jet or other printers.

FIG. 2 is a cross-section of the separator and paper assembly of FIG. 1, taking along line 2—2. In FIGS. 1, 2, 3, 4A and 4B, corresponding components have been given the same numerical designations.

In FIG. 2, printer tractor 42 has pin members thereon that fit into holes 43 (FIG. 1) of paper 16 to advance paper 16 and thus labels 20 and 32 after a line has been printed by printing element 34.

FIG. 3 is a front view of the separator depicted in the other Figures, but shown without the paper assembly. In FIG. 3, first attachment member 24 and second attachment member 26 are substantially parallel and are connected to edge 18. Rod member 22 has a first end positioned in one of a first plurality of slots (not shown) in member 24, whereas the opposing second end of the rod member is positioned in a corresponding slot of the second plurality of slots in second attachment member 26. As indicated by the arrows in FIG. 3, the separator may be moved in an upward or downward direction. The purpose of having several slots in members 24 and 26 to create several up positions is to enable the edge means to be positioned at different levels to accommodate varying sizes of adhesive labels.

The separator is in its down position when rod member 22 is positioned in the uppermost slot in member 24 and in member 26, corresponding to slot 30 (FIGS. 1 and 2) of member 24. In that down position, the labels are not separated from the backing paper. Referring again to FIG. 1, when rod member 22 is positioned in slot 30 the lower surface 44 of member 24 closes a switch (not shown) that deactivates the sensor means comprising sensor transmitter 45 and sensor receiver 46. At the same time, a manual switch 47 (FIG. 5) on the printer is activated to enable the printer to operate in its normal mode as if the label separator was not present.

FIG. 4A is a top view of the separator and label assembly when the separator is in one of its up positions. As shown in FIG. 4A, backing paper 16 has no labels downstream of edge 18, indicating that the labels have been removed from paper 16. Also in FIG. 4A, edge 18 provides an abrupt change of direction for paper 16 to allow a portion of label 20 to be separated from the paper.

Figure 4B:
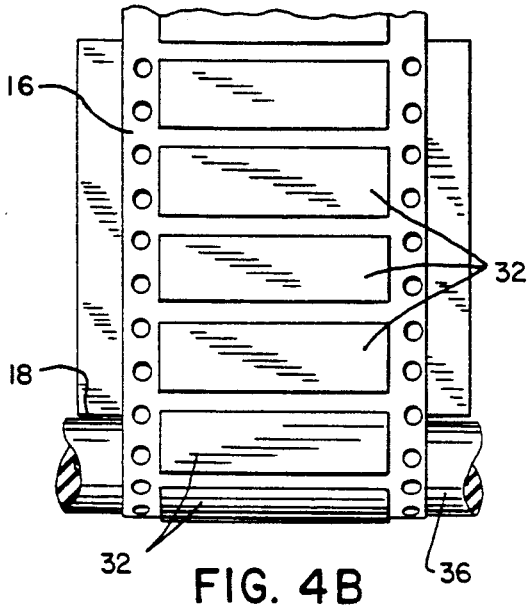
FIG. 4B is a top view of the separator and label assembly when the separator is in its down position.

In FIG. 4B, the separator is in its down position so that labels 32 are not removed from paper 16. Also, edge 18 is now located behind platen 36 so that it is not in a position to cause paper 16 to abruptly change its path.

Figure 5:
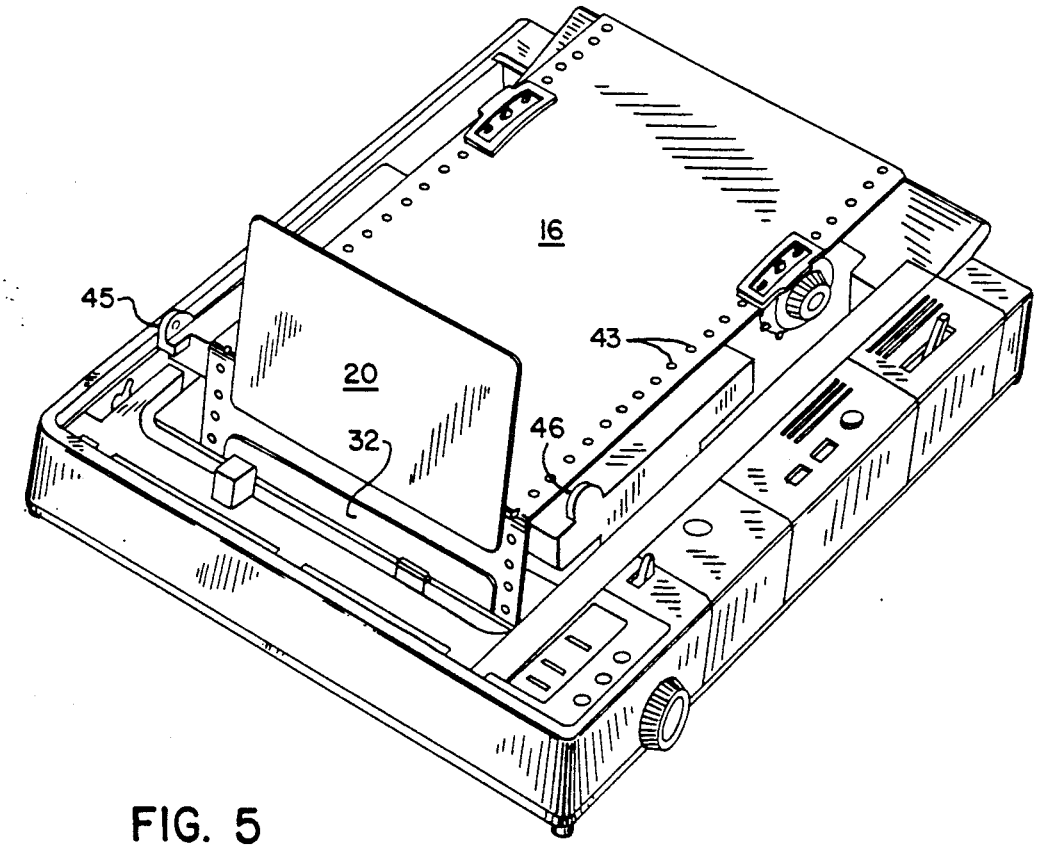
FIG. 5 is a perspective view of the separator used with a standard dot matrix printer.

FIG. 5 is a perspective view of the label separator used with a standard dot matrix printer. In FIG. 5, sensor transmitter 45 emits a light or other type of beam that is received by sensor receiver 46 when it is not necessary to remove a printed label. The beam is broken by that portion of the label which has been separated from the backing paper. If a label is currently being printed when the beam is broken, the printing of that label will continue. The beam will remain broken until the label is removed, preventing further printing of queued labels unless the sensor is deactivated as discussed above. The sensor means may output a visual or audible signal when a label has been at least partially separated from the paper to indicate that the label is ready to be removed.

Although several embodiments of the invention have been shown and described, alternate embodiments will be apparent to those skilled in the art without deviating from the intended scope of the present invention.

Therefore, the present invention is to be limited only by the following claims.

I claim:

1. Apparatus for separating at least a portion-of an adhesive label from a backing paper, said paper moving along a path in a printing device, comprising:

support means for supporting said backing paper while said paper moves along said path;

edge means, interconnected with said support means and having an up position and a down position, for engaging said backing paper; and adjustment means for adjusting the relative position of said edge means with respect to the position of said printing device to enable at least a portion of the adhesive label to be separated from the backing paper when said edge means is in an up position, and to prevent said label from being separated from said backing paper when said edge means is in a down position, said adjustment means including:

a rod member interconnected with said printing device; and at least one attachment member interconnected with said edge means, said attachment member having a receiving means for receiving said rod member.

2. The apparatus of claim 1, wherein said receiving means includes a plurality of slots adapted to receive said rod member.

3. The apparatus of claim 1, wherein said adjustment means includes:

a rod member interconnected with said printing device, said rod member having a first end and a second end;

a first attachment member interconnected with said edge means, said first attachment member having a first receiving means for receiving said first end of said rod member; and a second attachment member interconnected with said edge means, said second attachment member having a second receiving means for receiving said second end of said rod member.

4. The apparatus of claim 3 wherein said first receiving means includes a first plurality of slots, and wherein said second receiving means includes a second plurality of slots.

5. The apparatus of claim 1, further comprising;

a sensor means for detecting whether a label has been removed from said paper.

6. The apparatus of claim 5, wherein said sensor means outputs a visual or audible signal when a label has been at least partial separated from said paper.

7. The apparatus of claim 5, further comprising:

a switch that disables said sensor means.

8. Apparatus for separating at least a portion of an adhesive label from a backing paper, said paper moving along a path in a printing device, comprising:

support means for supporting said backing paper while said paper moves along said path;

edge means, interconnected with said support means and having an up position and a down position, for engaging said backing paper;

adjustment means for adjusting the relative position of said edge means with respect to the position of said printing device to enable at least a portion of the adhesive label to be separated from the backing paper when said edge means is in an up position, and to prevent said label from being separated from said backing paper when said edge means is in a down position, said adjustment means including:

a worm gear interconnected with said edge means; and a motor having a rotatable shaft that engages said worm gear so that rotation of said shaft rotates said gear to adjust the relative position of said edge means with respect to the position of said printing device.

* * * * *